United States Patent [19]

Hartelmüller

[11] 4,236,664

[45] Dec. 2, 1980

[54] STACKABLE TRANSPORT CONTAINER

[76] Inventor: Ludwig Hartelmüller, Erlaufstrasse 22, Südstadt A-2344, Austria

[21] Appl. No.: 39,166

[22] Filed: May 15, 1979

[30] Foreign Application Priority Data

Jun. 28, 1978 [AT] Austria ..... 4684/78
Oct. 19, 1978 [AT] Austria ..... 7525/78

[51] Int. Cl.[3] ..... B65D 57/00
[52] U.S. Cl. ..... 229/49; 229/32
[58] Field of Search ..... 229/49, 32

[56] References Cited

U.S. PATENT DOCUMENTS

| | | | |
|---|---|---|---|
| 775,090 | 11/1904 | Pilz | 229/49 |
| 1,050,407 | 1/1913 | Verrette | 229/32 X |
| 2,954,914 | 10/1960 | Herlihy | 229/49 X |
| 3,220,633 | 11/1965 | Swame | 229/49 |
| 3,270,943 | 9/1966 | Polenghi | 229/49 X |
| 3,372,855 | 3/1968 | Smith | 229/49 |
| 4,034,907 | 7/1977 | Emgdahl, Jr. | 229/32/ |

FOREIGN PATENT DOCUMENTS

| | | | |
|---|---|---|---|
| 1319389 | 1/1963 | France | 229/49 |

*Primary Examiner*—Davis T. Moorehead
*Attorney, Agent, or Firm*—Salter & Michaelson

[57] ABSTRACT

The invention relates to a stackable transport container, particularly for fruits, vegetables or dairy products, in which a one-piece blank has a quadrangular bottom and four walls rising upwardly and slanting slightly outwardly therefrom, which walls delimit an upwardly widening container filling space. In the four corners thereof there are arranged upright stacking supports formed by parts of the blank and serving for stiffening the container. The upper edges of the stacking supports are arranged below the upper edges of the adjacent container side wall sections so that during the stacking of two nested containers, the bottom of the upper container rests on the stacking supports of the lower container, the upper edges of the container side walls of the lower container securing the upper container against lateral displacement. Each stacking support is constituted by parts of the blank which can be pushed towards the container filling space and can be pushed back again so that these parts align with the adjacent sections of the container side walls. Thus transport room can be saved by nesting empty containers more closely one to each other after pushing back the stacking supports. Into the hollow space formed by each stacking support and the adjacent container side walls an insert body may be withdrawable inserted, which insert body rests on the container bottom and has an enlarged top surface.

11 Claims, 9 Drawing Figures

STACKABLE TRANSPORT CONTAINER

BACKGROUND OF THE INVENTION

The present invention relates to a stackable transport container, especially for fruits, vegetables or dairy products, made of a one-piece blank, e.g., of plastics, corrugated cardboard or cardboard, having a quadrangular bottom and four walls rising upwardly and slanting outwardly therefrom, which walls delimit an upwardly widening container filling space, in the four corners of which there are arranged, in the assembled state of said container, upright stacking supports formed by parts of said blank and serving for stiffening, the upper edges of which stacking supports lie below the upper edges of the adjacent container sidewall sections, to the effect that, during the stacking of two nested containers, the bottom of the upper container rests on the stacking supports of the lower container, the upper edges of the container side walls of the lower container securing the upper container against lateral displacement.

STANDARD OF ART

In a known container (Austrian Pat. No. 337,076) the stacking supports are constituted by flaps attached to the longitudinal side walls of the blank, which flaps, in the assembled state of the container, delimit in each container corner, together with the container side walls, a space of triangular cross section. The disadvantage of this arrangement lies in the fact that, during stacking, the bottom of the next higher container is supported only in the region of its extreme corners and that the supporting element constituted by said flap is only very short and, therefore, can be loaded to a very limited extent only. More important still, empty containers can be stacked only in the same way full containers are stacked, so that no space is saved during transport of empty containers.

OBJECT OF THE INVENTION

It is an object of the invention to overcome these disadvantages and to improve a stackable transport container of the above described type in such a manner as to facilitate stacking of full containers in high stacks, secured against slipping and suitable for handling on pallets, without damage to the goods.

A further object of the invention is to provide a design permitting the stacking of empty containers in a more space-saving manner than that of full containers.

It is another object of the invention to strengthen the stacking supports so that they can be loaded to a higher extent.

It is another object of the invention to provide a simple construction which can be easily re-enforced by withdrawable insert bodies so that extremely high loads can be dealt with.

These objects the invention achieves by providing stacking supports which are constituted by parts of the blank which can be pushed into the container space and can be pushed back again. In the pushed-in state, these blank parts form stable stacking supports which, compared with the above described prior-art design, offer an enlarged support area to the bottom of the next higher container. In the pushed-back state, this support function of the stacking supports is eliminated, so that empty containers can be densely nested and transported at a great saving of space.

According to a preferred embodiment of the invention, an insert body is provided which can be slid into, and again removed from, the hollow space of each stacking support, which insert body rests on the container bottom and is provided with an enlarged support surface for the bottom of the next-higher container, which support surface projects above the upper edge of the stacking support, but lies still below the upper edges of the adjacent container side-wall sections. These insert bodies carry the stacking pressure, so that the walls of the stacking supports formed by parts of the blank are largely relieved of this pressure. According to the invention, these insert bodies can also serve to grip and hold the folded-in flaps of the container and thereby to keep the container blank in the assembled state. This obviates the need for separate fastening means such as staples, eyelets, glueing points, etc. enabling savings in materials and working hours. If the insert bodies are withdrawn from the hollow spaces formed by the pushed-in stacking supports, the container can be totally flattened, affording the maximum saving of space for transport of empty containers. Yet with a few effortless manipulations, the flattened blank can be reassembled to form a container ready for use, even by unskilled manpower. After insertion of the four insert bodies into the four corners, the container is again fixed in the assembled state.

DESCRIPTION OF PREFERRED EMBODIMENTS

The accompanying drawings show schematic presentations of embodiments of the invention.

Figure 2:
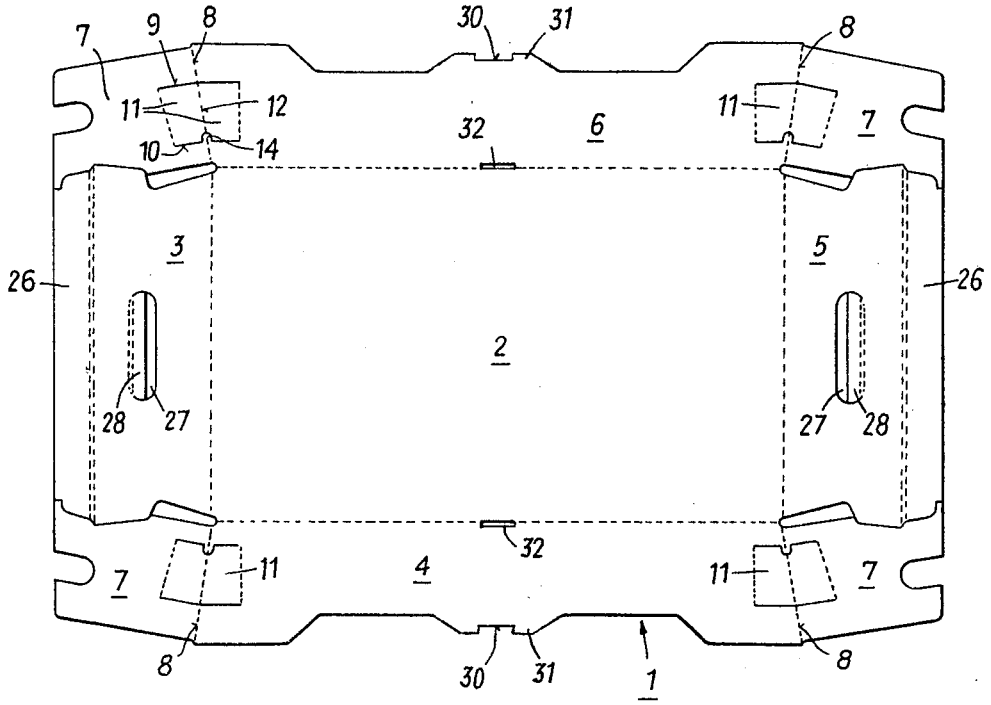
FIG. 2 shows the flattened blank associated with the container of FIG. 1.
Figure 1:
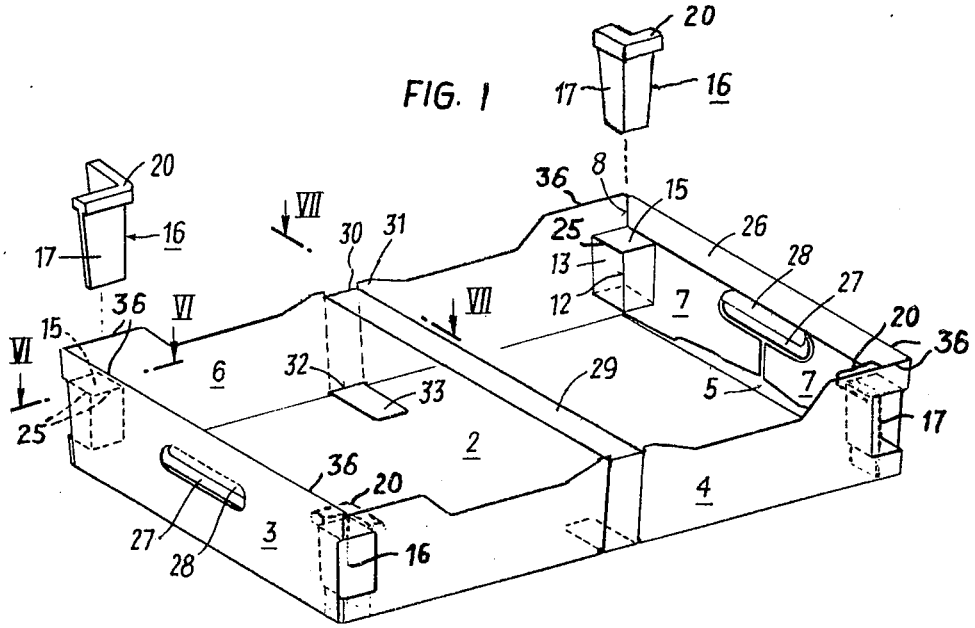
FIG. 1 is a perspective view of a container with withdrawable insert bodies in the stacking supports, with two insert bodies shown in the inserted, and two in the withdrawn state.
Figure 5:
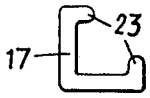
FIGS. 3,4 and 5 show an insert body in side, top and bottom surface view, respectively.
Figure 6:
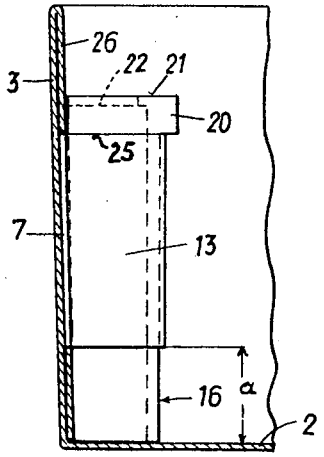
FIGS. 6 and 7 are cross sections according to planes VI—VI and VII—VII, respectively, of FIG. 1.
Figure 7:
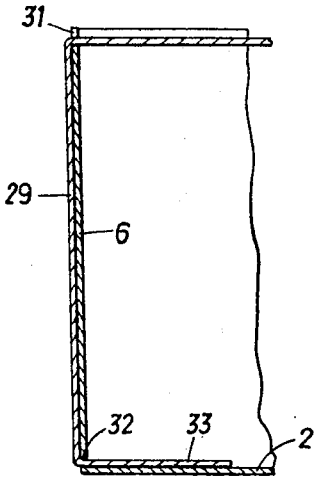

The container shown in FIG. 1 is made of cardboard, pasteboard, corrugated cardboard, plastics or similar suitable material which, if need be, can also be waterproofed. Particularly suitable are plastic webbed boards in which tearproof material, e.g., glass fibres, rovings, wires or the like have been inserted into the thin plastic board as reinforcing material, so that the plastic board will neither break nor tear at the folding lines. Such a board can be provided about the folding lines with a number of successive, spaced slots, to facilitate folding. The blank 1 (FIG. 2) is stamped out from this material and assembled in a manner which can be seen from FIG. 1. The four walls 3,4,5,6 are folded up from the bottom 2 at approximately a right angle but slightly slanting outwardly. The longitudinal walls 4 and 6 are provided at their ends with a flap 7 each. In the assembled state of the blank 1, these flaps 7 rest against the transversal walls 3 or 5 (FIG. 6). Each flap 7 has in the region of the folding line 8 two cuts 9 and 10 which, between them, delimit two quadrangular walls 11, portions of the blank 1, which are connected by a central folding line 12 being part of the folding line 8. During assembling of the blank 1, these walls 11 are pushed inwards and form an inward-projecting stacking support 13 of the blank 1 (FIGS. 1,6). These walls 11, however, even in the erected state of the container, can be pushed outwards so that they align with the longitudinal walls 4, 6 or with the transversal walls 3, 5, respectively, which feature enables a dense nesting of empty containers. A short, upright projection 14 increases the strength of the wall corner remaining below each stacking support 13. Each stacking support 13 delimits a hollow space 15 (FIG. 1), in horizontal cross section quadrangular, preferably square, into which space 15 there can be withdrawably introduced an insert body 16 made of a rigid material such as plastic material, wood or the like, and substantially fitting the space 15. Each insert body 16 consists of a basic body 17 of L-shaped cross section (FIGS. 3 to 5), the surfaces of the two legs of which include with the horizontal an angle $\alpha$ of about 88° to 89°. The edges 18 of the legs, on the other hand, include with the horizontal an angle $\beta$ of about 86° to 87°, which angle may correspond to the inclination of the container side walls 3 to 6. Each insert body 16 is introduced into the hollow space 15 in such a way that the walls formed by the legs of the basic body 17 contact the walls of the stacking support 13, thereby rigidifying this support which, in its turn, rigidifies the assembled blank 1. The insert body 16 is introduced into the hollow space to such a depth that its lower end 19 comes to rest on the bottom 2. The upper end of each insert body 16 has a flange-like extension 20, the upper surface of which constitutes a support surface 21 for the next-higher container and is provided with a groove 22 the shape of which is approximately identical to the bottom view (FIG. 5) of the insert body 16. The width of the groove 22 is slightly larger than the wall thickness of the basic body 17. At the ends of its L-shaped cross section, the basic body can be provided with inward-pointing reinforcement ribs 23 extending in an approximately vertical direction up to the flange-like extension 20. The latter also constitutes an additional insertion stop for the insert body 16, the underside 24 of which flange-like extension coming to rest on the upper edge 25 (FIG. 1) of the stacking support 13, thereby protecting this edge 25 from being damaged.

Figure 3:
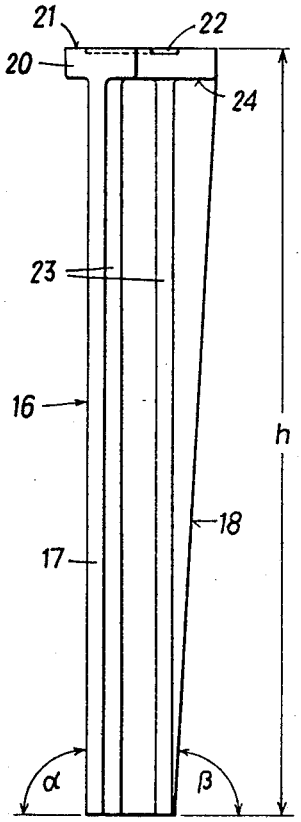
Figure 4:
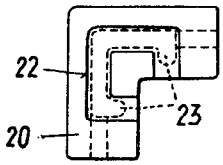

Due to the conicity of the walls 3,4,5,6 it is possible for the identical containers to be stacked and nested, with the upper container reaching into the space of the lower container until its bottom comes to rest on the supporting surfaces 21 of the insert bodies 16. These insert bodies 16 take up the entire stacking pressure and transmit it to the lower sets of insert bodies 16 of the stack, so that the contents of the containers are under no load, since, due to the insert bodies 16, the bottoms of the next-higher containers are always kept at a distance from the bottoms of the next-lower containers corresponding to the height h of the insert bodies (FIG. 3). By selective use of insert bodies 16 with different heights h, this distance can be adapted to the kind of goods to be transported, so that the usable height of the containers will will always match prevailing conditions, saving space in railway cars, lorries, cooling rooms and so on.

Maintaining and fixing the container in the assembled state is also advantageously effected by means of the insert bodies 16. To this end, the container blank 1 is provided at the transversal walls 3 and 5 (FIG. 2) with a flap 26 each, which flaps, after folding up of the walls 3 to 6, are inwardly folded over the flaps 7, before the insert bodies 16 are introduced into the hollow spaces 15. The flange-like extension 20 of the insert bodies 16 wedge these flaps 26 against the flaps 7 over which they were folded, locking both in their assembled position. Each of the walls 3 and 5 is provided with a cut-out 27, which constitutes a grip opening, the upper edge of which is provided with a reinforcing flap 28 folded upwards in erected state of the container.

The most favorably fixing of the flaps 26 and, thus of the entire assembled blank 1 is obtained when the flange-like extension 20 presses against the lower edge region of the inward-folded flap 26.

To facilitate handling of the container, it is possible to provide a carrying handle 29 which extends transversally across the container space and is guided by recesses 30 in projections 31 of the upper edges of the container walls 4 and 6. From these recesses 30, the material strip forming the carrying handle 29 is led downwards along the outer faces of the walls 4 and 6, to the container bottom 2, and is inserted through openings 32 in each of the walls 4 and 6 inwards into the container, so that the flap-like ends 33 of the material strip forming the carrying handle 29 come to rest against the container bottom 2. Using for the carrying handle 29 a material which permits relatively sharp bends without the danger of producing, in the course of use, tears or fracture points, expecially when using plastic ribbed boards, but also corrugated cardboard or pasteboard, the above design of the carrying handle 29 ensures a secure mounting of same on the container, obviating the need for separate fasteners for the carrying handle 28. By pulling the ends 33 out of the openings 32, the carrying handle 29 can be easily removed from the container.

The upper surface of the carrying handle lies on the same height as the support surfaces 21 of the insert bodies 16, so that the carrying handle 29 forms an additional support for the bottom of the next-higher container, preventing sagging of that bottom.

The insert bodies 16 are in surface contact with the substantially vertical walls of the pushed-in stacking supports 13. These walls end at a distance $\alpha$ from the bottom 2 (FIG. 6), so that, at their uppermost and their lowermost parts, the insert bodies are held on sides opposite to the sides on which their central sections are held. This contributes to the secure seating of the insert bodies.

Figure 8:
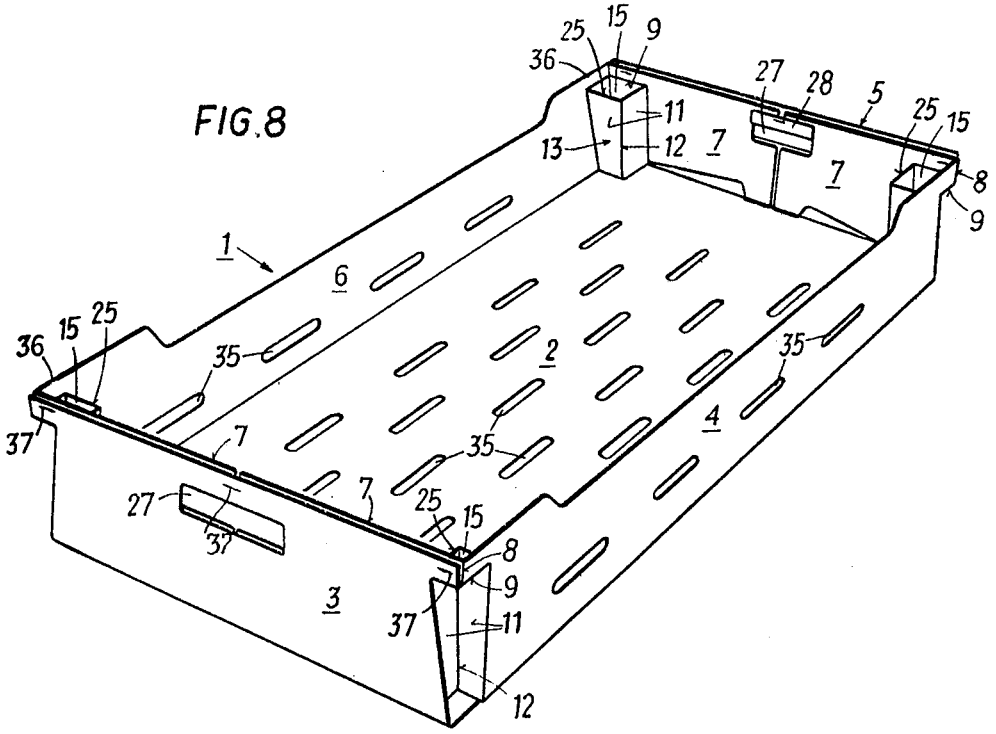
FIG. 8 shows another embodiment of the invention, but without insert bodies.
Figure 9:
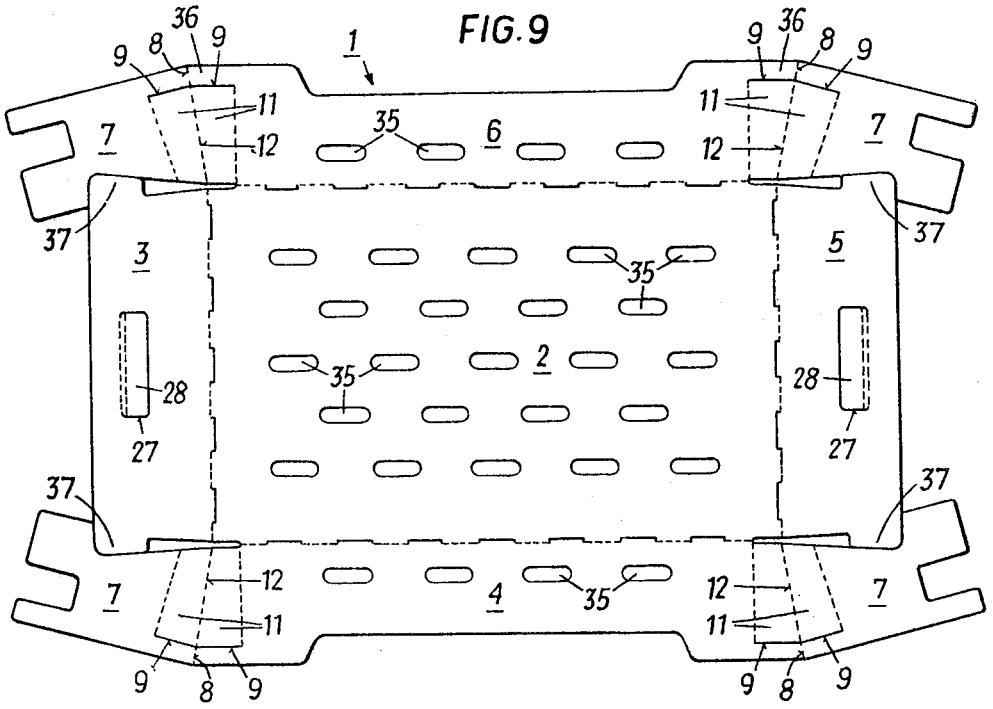
FIG. 9 shows the blank associated with the container of FIG. 8.

According to the embodiment shown in FIGS. 8 and 9, the container has no insert bodies in the stacking supports 13, which, therefore, take the entire stacking pressure. To this end, each stacking support 13 is constituted by two flaps 11 of the blank 1 (FIG. 9) which, in the assembled state of the container (FIG. 8), form quadrangular walls 11 extending approximately vertically down to the bottom 2 of the container, thus, transferring the stacking pressure to the container bottom 2. Fixing the container in the assembled position is in this embodiment effected by known means such as, e.g., staples 37, or glueing (also hot-melt glueing), or the like.

In both embodiments, the pushed-in stacking supports 13 form outside recesses at the container corners constituting possible gripping holds which may facilitate handling of heavily loaded containers. As is clearly seen from FIGS. 1 and 8, the upper edges 25 of the stacking supports 13 are always lower than the upper edges 36 of the adjacent sections of the walls 3,4,5 and 6, so that the upper container in a stack is always nested in the lower container and secured against lateral displacement. The quadrangular horizontal cross section of the stacking supports 13 tapers down toward the container bottom 2, increasing stability.

As shown in FIGS. 8 and 9, the blank 1 can be provided with ventilation openings 35 for the goods to be transported, especially for vegetables, fruits or the like.

It is, however, obvious that the embodiment of FIGS. 8 and 9 can also be used with insert bodies 16 in the stacking supports 13. It is of advantage to make the insert bodies 16 from cheap, but strong material. They are, for instance, molded from polystyrene. Low-pressure polyethylene and, especially recycled plastics are also suitable, the latter being particularly economical. The material for the blank should be compatible with foodstuffs and, for reasons of environmental protection, combustible without residues.

As it can be easily seen from the drawings, particularly from FIGS. 1 and 2 and FIGS. 8 and 9, respectively, the quadrangular parts 11 of the blank forming the stacking supports can be easily pushed outwards so that these parts 11 align with the longitudinal walls 4,6 and with the transversal walls 3,5 respectively, of the container. This can be done even in the assembled or erected state of the container, for example by pressing outwardly against the folding-line 12 of the two quadrangular parts 11 and simultaneously bending the neighbouring walls 3 or 4 or 5 or 6 so that the angle included by these container side walls is increased and the respective corner is flattened. The quadrangular parts snap then outwardly and, as already mentioned, lie then aligned with the side walls of the container. This, of course, can be done only then, if the support bodies 16 are withdrawn from the hollow space 15 surrounded by the inwardly folded quadrangular parts 11 so that the support bodies 16 prevent an unintended outward movement of the quadrangular parts 11, for example due to the pressure of the goods contained in the filling room of the container. When the quadrangular parts 11 are pressed outwardly they form no more a support for the next higher container in the stacked container column. The containers thus nest very closely into each other so that empty containers can be stacked saving room.

What is claimed is:

1. A stackable transport container comprising a one-piece container blank which can be flattened when not in use, having a quadrilateral bottom and four walls extending from the bottom in an upward and outwardly inclined direction to define a container space widening in an upward direction, stack supports formed of portions of the container blank wall portions which are adapted to be pushed into the container space and pushed back out of the container space, being provided at four corners of the container space in the erected condition of the container and having their upper edges located at a level that is lower than the upper edges of the adjacent portions of the walls of the container, said stack supports being formed of quadrilateral container blank portions which are in connection with the adjacent wall portions of the container along folding lines, all of said folding lines being located in a vertical position in the erected condition of the container and diverging from each other toward the upper edges of the stack support, said blank portions of each container space corner defining together with the imaginary extensions of the side walls of the container in the erected condition of the container a cavity that tapers in a downward direction and that extends from the upper end of the stack support to its lower end, the upper end of said cavity being open, and an insert member of rigid material being provided for each of said container space corners that is inserted in or removed from the cavity of each stack support, said insert member, when inserted in the cavity, resting on the bottom of the container and having a base body and a supporting surface extending above the upper edge of the stack support but being located at a level that is lower than the upper edges of the adjacent portions of the side walls of the container, so that, in use, with an upper container being stacked on a lower container, said supporting surface supports the bottom of an immediately overlying container within a stack and the upper edges of the walls of the lower container prevent the upper container from lateral sliding movement relative to the lower container, the surfaces of each insert member contacting the walls of said stack supports, and each insert member, when in position, gripping an inwardly folded flap of the container and thereby locking the container blank in the erected position thereof.

2. A container as claimed in claim 1, wherein the quadrilateral container blank portions of each stack support are both connected to one of the adjacent container walls and are connected to an extension of the container wall that abuts the other of the container walls in the erected condition of the container.

3. A container as claimed in claim 1, wherein said stack supports terminate at a level above the bottom of said container.

4. A container as claimed in claim 1, wherein each insert member is formed with an enlarged supporting surface.

5. A container as claimed in claim 1, wherein the base body of said insert member is formed with an L-shaped cross section.

6. A container as claimed in claim 5, wherein said L-shaped base body includes legs, the edges of which constitute surfaces of the insert member facing the container side walls and being inclined to a degree corresponding to the slant of said container side walls.

7. A container as claimed in claim 1, wherein said rigid material is a material selected from the group of wood or polystyrene or low-pressure polyethylene or recycled plastic material.

8. A container as claimed in claim 1, wherein said insert members are formed with an L-shaped cross section and include longitudinally extending reinforcement ribs.

9. A container as claimed in claim 8, wherein said reinforcement ribs are located on the inner side of said L-shaped cross section.

10. A container as claimed in claim 1, wherein said insert member is replaceable by other insert bodies of different height.

11. A container as claimed in claim 5, wherein said insert members are located in surface contact with said walls of said stack supports.

* * * * *